US006182954B1

(12) United States Patent
Zhang

(10) Patent No.: US 6,182,954 B1
(45) Date of Patent: Feb. 6, 2001

(54) MAGNETORHEOLOGICAL FLUID WORK PIECE HOLDING APPARATUS

(76) Inventor: Xuesong Zhang, 2408 Albert Rasche Dr., Cape Girardeau, MO (US) 63701

( * ) Notice: Under 35 U.S.C. 154(b), the term of this patent shall be extended for 0 days.

(21) Appl. No.: 09/356,342

(22) Filed: Jul. 19, 1999

(51) Int. Cl.[7] ..... B25B 11/00
(52) U.S. Cl. ..... 269/7
(58) Field of Search ..... 269/7, 8, 20, 266

(56) References Cited

U.S. PATENT DOCUMENTS 3,953,013 * 4/1976 Griffith et al. ..... 269/7
5,971,835 * 10/1999 Kordonski et al. ..... 451/38

* cited by examiner

*Primary Examiner*—Robert C. Watson
(74) *Attorney, Agent, or Firm*—Polster, Lieder, Woodruff, & Lucchesi, L.C.

(57) ABSTRACT

A work piece holding apparatus uses a magnetorheological fluid for holding a work piece firmly for machining process and/or measurements. The apparatus includes a cell with a hollow space in it and magnetorheological fluid is put into the hollow space. A special fixture with a hollow space in it is used to hold a work piece by screws in the wall or walls. The fixture with a work piece in it is fastened inside the cell dipped in magnetorheological fluid to absorb the extra force beyond the holding power supplied by magnetorheological fluid alone. It then overcomes any climbing that may happen during any process. A magnetic field is supplied to the cell to make the magnetorheological fluid work. It is well known that if a magnetic field is applied to a magnetorheological fluid, the viscosity of the fluid will be increased tremendously and behaves almost like a solid. A pressure applied in this apparatus to the magnetorheological fluid while the magnetic field is "on" will increase the viscosity of a magnetorheological fluid many times. The pressurized magnetorheological fluid supplies a large average pressure (holding force) to a work piece, and the special fixture mentioned then absorbs the overshoot caused by the machining process and/or performing measurements. This invention makes the magnetorheological fluid enter practical industrial applications especially in fixture apparatus applications.

11 Claims, 4 Drawing Sheets

MAGNETORHEOLOGICAL FLUID WORK PIECE HOLDING APPARATUS

CROSS-REFERENCE TO RELATED APPLICATIONS

| Patent | Inventor | Issued | Title |
|---|---|---|---|
| US2575360 | Robinow, J | 1951 | |
| U53818646 | Peterson | 6/1974 | Fixture for Holding Precisely Shaped Parts |
| US4033569 | Dunn et al | 7/1977 | Deformation-Preventing workpiece-holding fixture for machine tools |
| US4601110 | Charles et al | 6/1986 | Fixture Device |
| US4968103 | Haddad et al | 11/1990 | Modular workpiece Holding apparatus |
| US5267633 | Shigeki et al | 12/1993 | Electrorheological fluid-applies apparatus, electro-rheological fluid-applied vibration controller, and electrorheological fluid-applied fixing apparatus |
| US5277281 | Carlson et al | 1/1994 | Magnetorheological fluid damper |
| US5417314 | Sproston et al | 5/1995 | Electrorheological fluid damper |

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention refers to a fixture apparatus that uses a combination of magnetorheological fluids and a special fixture to hold irregular shaped as well as regular shaped work pieces for precision machinery and measurements or other applications that require such apparatus.

It is an applied apparatus making use of a magnetorheological fluid or magneto-viscous fluids. The viscosity of the fluids changes upon application of a magnetic field produced either by a permanent magnet or an electromagnet. A specially designed mechanical fixture is used to hold any regular or irregular shaped work pieces.

In this apparatus, the magnetorheological fluid supplies the average pressure to the work piece that is fastened into it. The special fixture absorbs the extra force, preventing movement or climbing of the work pieces inside the apparatus during machining process.

Previously, a work piece to be machined with an irregular shape was fixed by clamps or some fixtures. Because they solely rely on the force from the clamps or fixtures, the process can cause permanent damage to the work piece. Another way was using a low-melting point metal alloy to hold a work piece by melting the alloy to liquid form, then dipping the work piece into the melted alloy, and then cooling the alloy to hold the work piece. This heating and cooling process will introduce strains in the work piece. Most of the low-melting point alloys have a harmful high vapor pressure, which will damage to the health of the personnel involved and will pollute the environment in the long run.

This invention has solved the long unsolved problem in industry—to firmly hold an irregular shaped work piece in a fixture to perform precision machining and/or measurements without introducing permanent deformation in the work piece or other damages, especially when the work piece is made of heat sensitive or non-magnetic materials. The invented apparatus, naturally, works even better for conventional work pieces with regular shape.

This invention has made magnetorheological fluids enter practical industrial fixture applications. Besides using the applied conventional magnetorheological fluid, a pressure in one or more directions, especially in the magnetic field direction is applied. This will greatly increase the strength of the fluid (i.e., the hold force of the fluid). Most importantly, a special fixture is used to accurately position and hold a work piece inside magnetorheological fluids to prevent the work piece from climbing which is a fatal drawback to the practical applications of magnetorheological fluids. Therefore, this invention overcomes the drawback of conventional fixture apparatus. This makes practical application of magnetorheological fluids in industry or research institutes possible. The obvious advantages of the apparatus compared with other apparatus available are:

i. The phase of a magnetorheological fluid is reversible with the field on or off, which is convenient to use. It can hold any irregular as well as regular shaped work piece firmly for precision machining and/or measurements.

ii. Since no heating or cooling cycle is introduced into the system during the process, the least amount of damage to the work piece is introduced.

iii. The work piece can be any material: metals or non-metals and magnetic materials or non-magnetic materials.

iv. Because magnetorheological fluid is a very good shock absorbing material, the apparatus will reduce the vibration in the work piece due to the processes (i.e., cutting, milling or grinding process).

v. It is environmentally safe.

SUMMARY OF THE INVENTION

The primary objective of the invention is to provide an apparatus, which can hold irregular shaped as well as regular shaped work pieces firmly, and accurately to do machining, measurements, and other purposes. In this invention, a work piece holding apparatus with a combination of a magnetorheological fluid and a special fixture is applied. In some special situations, it may even work with only the magnetorheological fluid or the special fixture alone. The apparatus is comprised of a cell that contains a magnetorheological fluid, a special fixture that will hold the work piece, and a magnet with either a permanent magnet or an electromagnet to supply the magnetic field. The cell is placed in the gap of the magnet. The gap can be adjusted to compress the fluids inside cell. The cell has two walls and a centerpiece. Each wall is made of two pieces, one part is made of non-magnetic material which holds the other part made of magnetic material in contact with one of the poles of the magnet. The center frame is used to form a hollow center for the cell and holds a special fixture at a fixed position inside the cell. The special fixture holds a work piece inside the center frame. The center frame is made of non-magnetic material. The special fixture can be made of either magnetic or non-magnetic material. On each side of the center frame is a "U" shaped O-ring groove or flexible sealing material. The special fixture has a hollow center and a wall or walls surrounding the hollow center, depending on different geometries.

It can be cylindrical, triangular or rectangular, depending on the geometries of the work piece to be processed. It can be fastened to the hollow center of the center frame of the cell. On the surrounding wall or walls of the fixture, there are several uniformly distributed threaded holes. The special fixture holds the work piece inside the fixture by several screws through the threaded holes. The cell walls holding the center frame are pressed together to form a cell that is sealed by an O-ring or other flexible material. The magnetorheological fluid is placed inside the cell. The cell is placed into the gap of the magnet. After turning on the magnetic field, a pressure is applied through a clamp or other means to reduce the gap of the magnet by compressing the cell walls toward each other, which in turn compressing the O-rings or the flexible sealing material. The magnetorheological fluids are squeezed inside the cell by this process. This will change the structure of the fluid and increase the pressure applied to the work piece inside the special fixture. Therefore, the pressurized magnetorheological fluids supply an average holding force to a work piece and the special fixture absorbs extra peak force that will prevent displacement of the work piece. With this combination, any work piece placed inside the cell will be held firmly in place and ready to be used for precision cutting, grinding, or accurate measurement.

DESCRIPTION OF THE PREFERRED EMBODIMENT

Figure 1A:
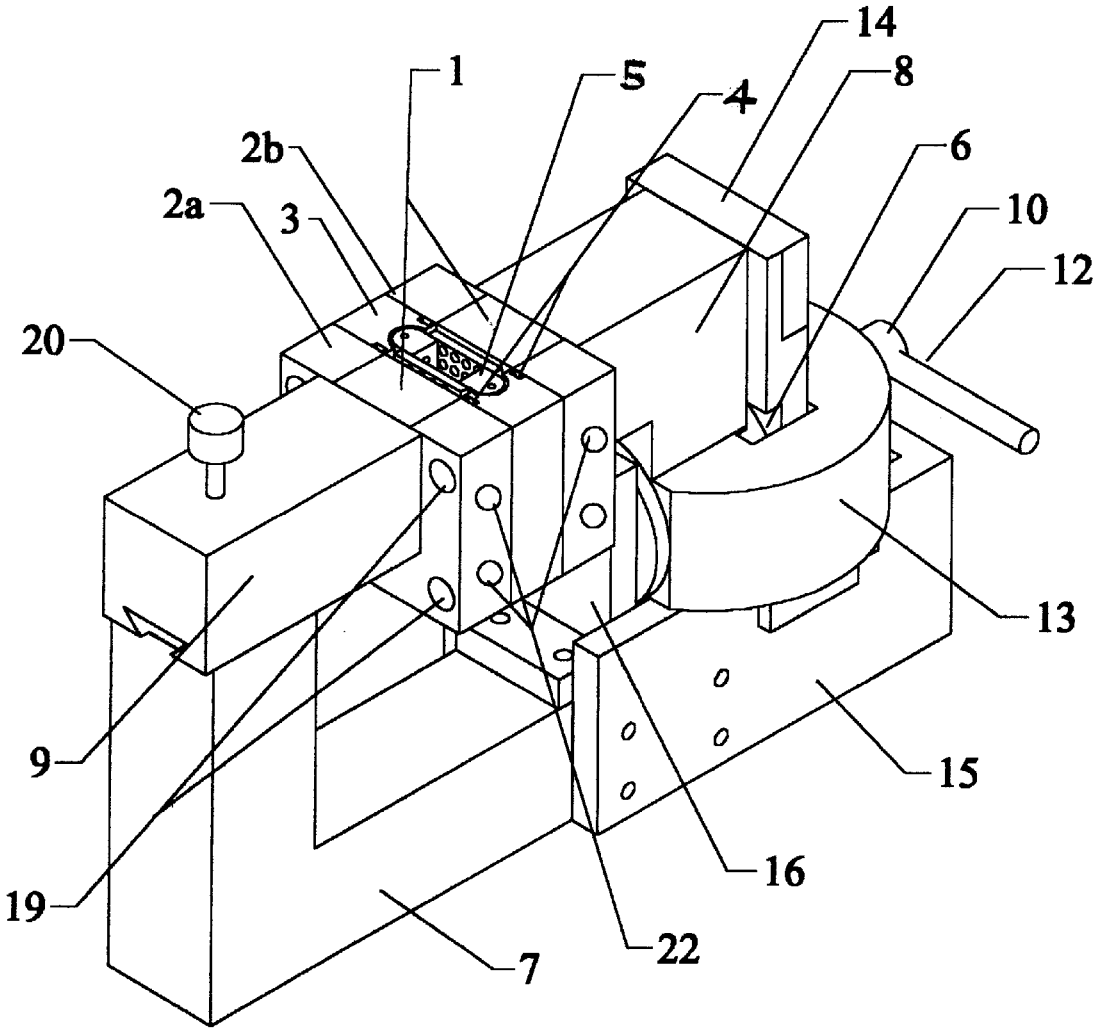
FIG. 1A is a schematic diagram of a preferred embodiment in which an apparatus made of a combination of magnetorheological fluid and a special fixture with a permanent magnet to supply a magnetic field.
Figure 1B:
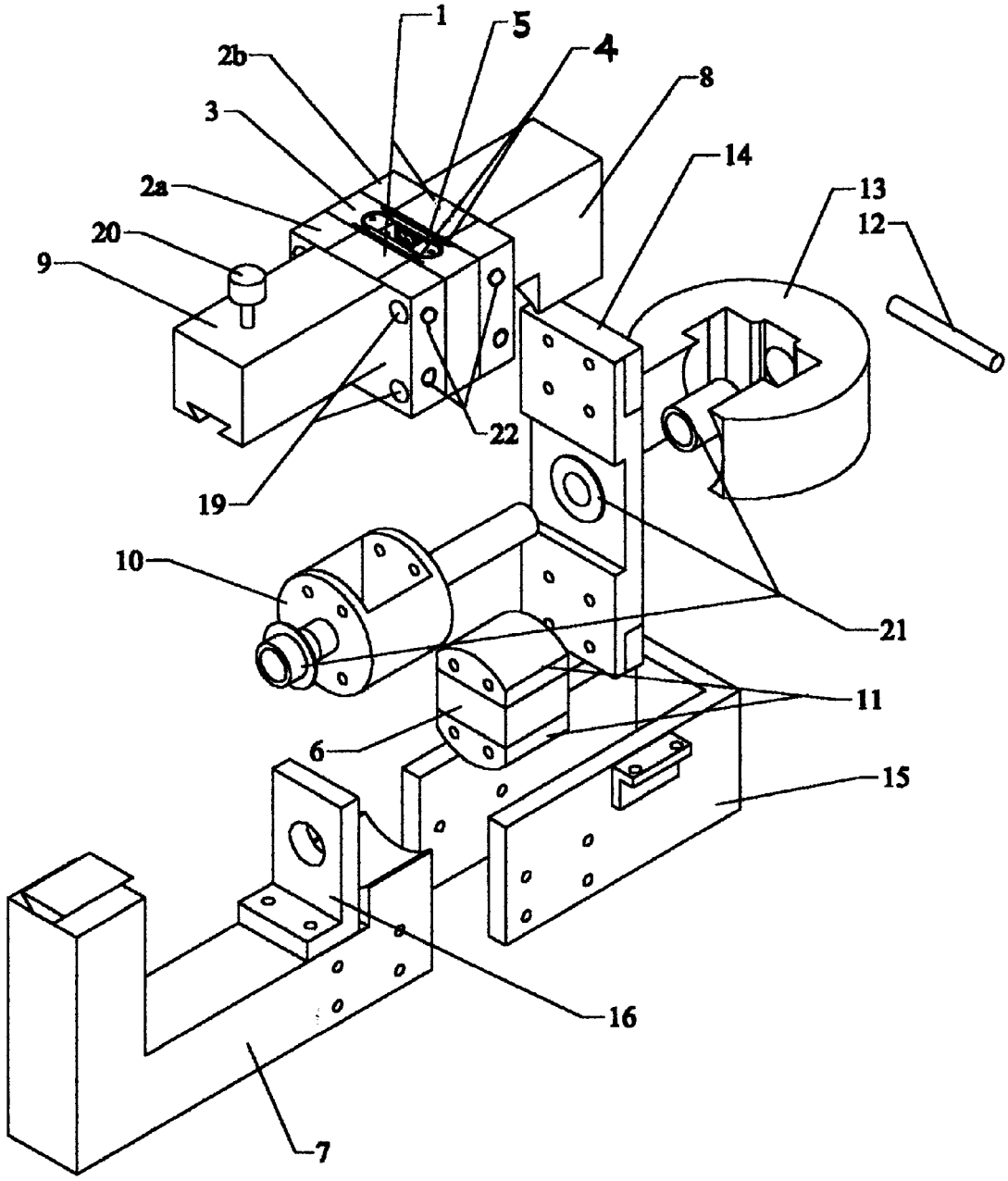
FIG. 1B is an exploded view of FIG. 1A.
Figure 2:
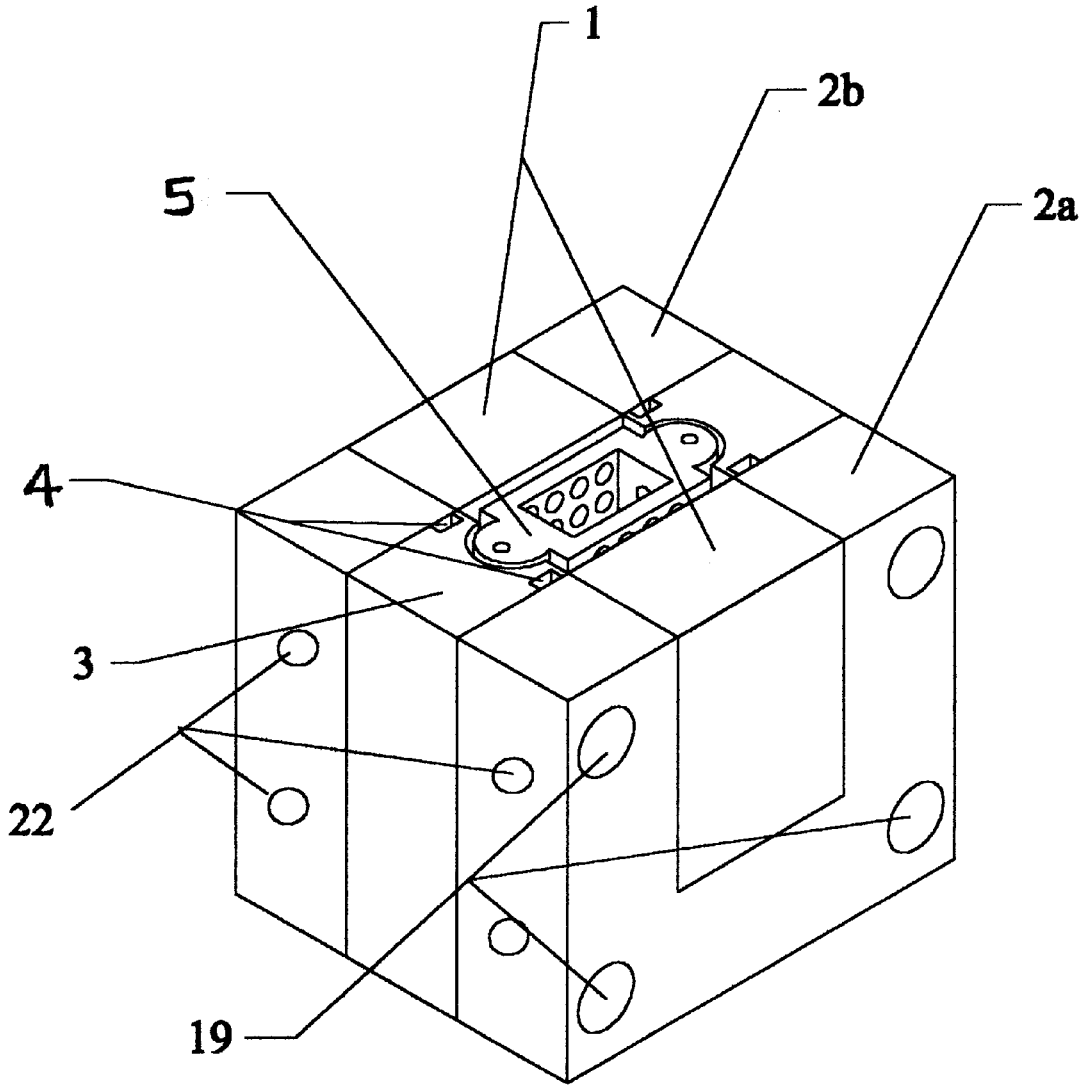
FIG. 2 is a detailed drawing of a cell in FIG. 1A and FIG. 1B.
Figure 3:
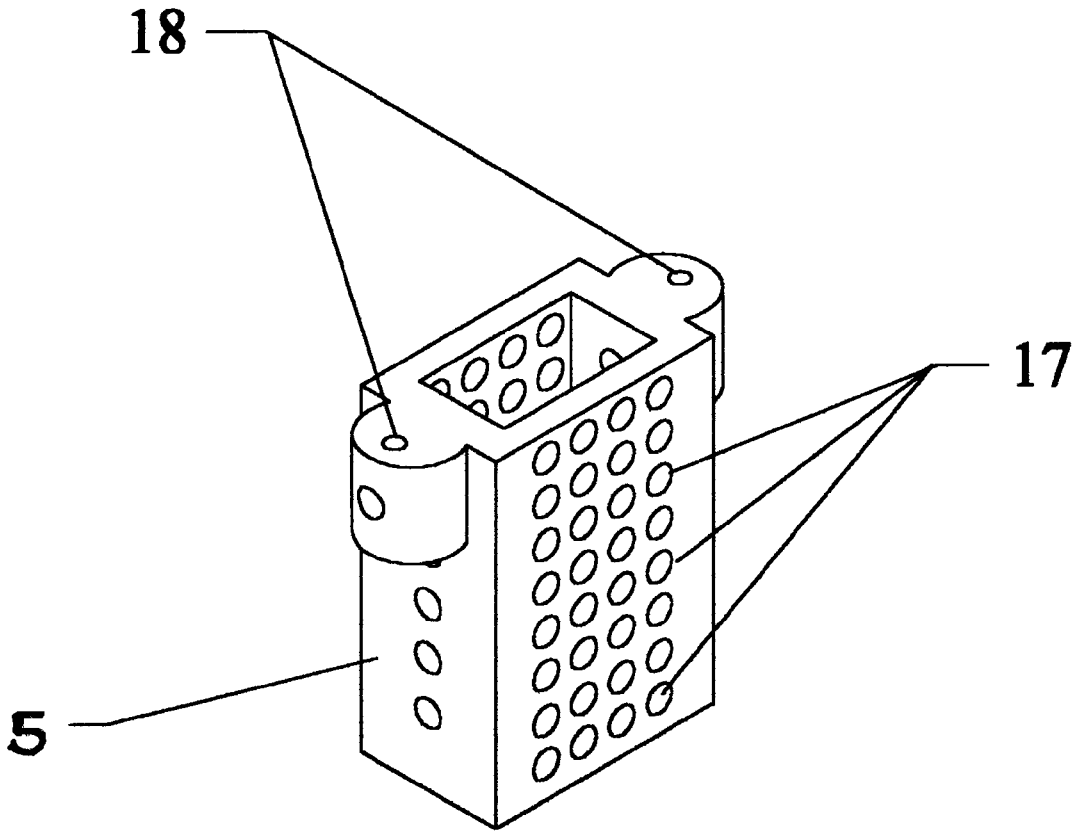
FIG. 3 is a detailed drawing of a special fixture in FIG. 1A, FIG. 1B, and FIG. 2.

FIG. 1A is a schematic diagram illustrating an embodiment in which is an apparatus made of the combination of magnetorheological fluid and a special fixture. FIG. 1B is an exploded view of FIG. 1A. In FIG. 1A and FIG. 1B, 1 to 5 is a magnetorheological fluid cell, which is shown in detail in FIG. 2. A special fixture 5 is drawn in detail in FIG. 3. O-rings 4 or other flexible seals are put in between the two cell walls as shown in FIG. 2. Magnet 6 and magnet shoes 11 and magnet arms 7, 8 and 9, supply a strong magnetic field to cell (1-4). Magnet 6 can be either a permanent magnet or an electromagnet. In FIG. 1A and FIG. 1B, a main embodiment drawing with a permanent magnet is shown. In FIG. 1A and FIG. 1B, a permanent magnet 6 made of rare earth alloys is used as the magnetic field source. Two solid arch shaped shoes 11 are placed on the top and bottom of magnet 6. Magnet holder 10 was used to hold the magnet and magnet shoes 11 together. Magnet holder 10 is made of non-magnetic materials. The magnet 6, magnet holder 10, and magnet shoes 11 together form a cylinder shaped magnet assembly. The cylinder shaped magnet assembly, magnet arms 7, 8, and 9, along with cell (1-4) form a closed loop magnet circuit. The structure makes the magnet assembly rotate freely with two shaft ends of the magnet holder 10 in bushing bearings. This structure's main function is to easily switch on or off a magnetic field to cell (1-4). In FIG. 1A and FIG. 1B, one end of the magnet holder 10 has a turning lever 12 passing through it. Lever 12 is used to turn the magnet 90 degrees to switch on or off the magnetic field. Horseshoe shaped disk 13 is made of a magnetic material whose function is to bypass the magnetic field to cell (1-4) and reduce the energy loss of permanent the magnet 6. Magnetic arms 7, 8, 9, and magnet shoes 11 are made of soft iron or good magnetic materials. Connection plate 14 is to connect magnet and magnet arms together to form a magnetic circuit. Bottom frame 15 is used to support horseshoe disk, and bushing frame 16 along with connection plate 14 are made of non-magnetic materials whose function is to support and position the magnet assembly (6, 10, and 11). Magnet arms 7, 8, and 9 are made of a good magnetic material. Magnet arm 9 is attached to arm 7 and cell (1-4) and is able to be displaced relative to magnet arm 7 along the cell (1-4) direction. Fastening bolt 20 is to fix the position of arm 9 relative to arm 7 and cell (1-4). FIG. 2 is the detailed drawing of cell (1-4) in FIG. 1A and FIG. 1B. In FIG. 2, the cell (1-4) is shown in detail. Cell walls 1 are made of magnetic material, such as soft iron, cast iron or other magnetic alloys-preferably ones with high permeability and low residual magnetization. This also applies to magnet shoes and all magnet arms in the magnet circuit. Cell wall frame 2*a* and 2*b* and center frame 3 are made of non-magnetic material such as aluminum, brass or stainless steel. Bolts at hole 22 connect cell wall 1 and cell wall frame 2*a*, and they also connect cell wall 1 and cell wall frame 2*b*. The center frame 3 has grooves for O-rings 4 on both sides. The magnetorheological fluid is contained inside the cell by the O-rings 4 and makes the displacement between the two cell walls toward each other possible when a pressure is applied between the ends of magnet arm 8 and magnet arm 9. Cell wall frame 2*a* has four through holes and cell wall frame 2*b* has four threaded holes and center frame 3 has four through holes. Four bolts at holes 19 are counter-sunk in cell wall 2*a* to fasten cell walls 1, cell wall frame 2*a*, 2*b* and center frame 3 together. Special fixture 5 in FIG. 2 was drawn in details in FIG. 3. In FIG. 3, a special fixture 5 with rectangular shaped hollow center is shown. Special fixture 5 can be made of either magnetic material or non-magnetic material. The threaded holes 17 on fixture 5 are made in pairs from one side to the other; they have a common center for each pair. The work piece to be processed or measured is fastened inside the fixture 5, which uses screws made of material with less hardness compared to the work piece. Magnet holder 10 has two shaft ends supported by bearings on connection plate 14 and bushing frame 16. One end of magnet holder 10 has a through hole in which a turning lever 12 passes through to turn magnet.

DETAILED DESCRIPTION OF THE INVENTION

The basic function of the invention can be explained by the drawings mentioned before. First, place a work piece to be processed or positioned, or measured, inside fixture 5 in FIG. 1 and the fixture itself was shown in FIG. 3. Secondly, position and fasten the work piece inside fixture 5 in FIG. 3 with several setscrews. The number of screws depends upon the size and geometry of the work piece. It is important to leave the rest of the threaded holes open, which makes the magnetorheological fluids able to enter the fixture freely and makes enough contact area between the magnetorheological fluid and the surface of the work piece. Because most of the screws are used in pairs on both sides of the work piece, the stress and distortion of the work piece are minimized. Put the cell (1-4) together as shown in FIG. 2. Next, place the magnetorheological fluid inside the cell (1-4) before fastening the fixture inside the cell (1-4). The magnetorheological fluid can be any magnetorheological fluid. What is used here is a mixture of carbonyl iron powder and silicon oil. The preferred volume percentage of the powder in the powder and oil mixture is 20% or above. It is important not to tighten the cell walls together too much before it is put inside a magnetic field but just enough to prevent the fluids from leaking, hence to leave enough room for compression. Carefully fasten a work piece inside the special fixture with screws through the threaded holes in the special fixture. After that, slowly put fixture 5 with the work piece in it inside the cell and fasten fixture 5 to center frame 3 of the cell (1-4). To get the best result, cell (1-4) can be put inside a small vacuum chamber to get rid of the air trapped inside the fluid. However, in most applications, this procedure is not necessary. Then, place the entire cell assembly into the gap of the magnet. For a permanent magnet, turn the magnet 90 degrees to apply a magnetic field to cell (1-4). For an electric magnet, apply a current to a coil in magnet to produce a magnetic field to cell (1-4). Apply a pressure between magnet arms 8 and 9 to pressurize cell (1-4). The pressure will squeeze the O-rings 4 between the cell walls and transfer the pressure to the magnetorheological fluid inside cell (1-4). This will supply a large pressure to the work piece fastened inside special fixture 5. The fastening bolts at holes 19 can be tightened to hold the pressurized cell (1-5). Lock bolts 20 are used to keep the position of magnet arms 7 and 9 and cell (1-5) fixed. The external force then can be withdrawn. The whole system can be fastened to any place and ready to perform the functions required for the work piece—cutting, grinding, milling, positioning, and performing measurements.

List of Reference Numbers in Drawings

| NUMBER | NAME |
|---|---|
| 1 | CELL WALLS |
| 2a | CELL WALL FRAME |
| 2b | CELL WALL FRAME |
| 3 | CENTER FRAME OF CELL |
| 4 | O-RINGS |
| 5 | SPECIAL FIXTURE |
| 6 | PERMANENT MAGNET |
| 7 | LOWER MAGNET ARM |
| 8 | UPPER MAGNET ARM |
| 9 | MOVABLE MAGNET ARM |
| 10 | MAGNET HOLDER |
| 11 | MAGNET SHOES |
| 12 | TURNNING LEVER |
| 13 | HORSE SHOE DISK |
| 14 | CONNECTION PLATE |
| 15 | BOTTOM FRAME |
| 16 | BUSHING FRAME |
| 17 | THREAD HOLES |
| 18 | THROUGH HOLES |
| 19 | HOLES FOR FASTENING BOLTS |
| 20 | LOCK BOLT |
| 21 | BEARINGS |
| 22 | FASTENING HOLE |

What I claim as my invention is:

1. A magnetorheological fluid apparatus for work piece holding, comprising:

a. a cell containing a hollow space and at least a wall surrounding said space to hold a volume of said magnetorheological fluid;

b. means to seal magnetorheological fluids from leaking from said cell;

c. means for applying a magnetic field by at least one permanent magnet to said cell and said magnetorheological fluid;

d. means to switch on and off magnetic field to said cell.

2. A magnetorheological fluid apparatus for work piece holding, comprising:

a. a cell containing a changeable volume hollow space and at least a wall surrounding said space to hold a volume of said magnetorheological fluid;

b. means to seal magnetorheological fluid from leaking from said cell;

c. means for applying a magnetic field by at least one permanent magnet to said cell and said magnetorheological fluid;

d. means to adjust a gap in said magnet in which said cell is placed in said magnet gap;

e. means to switch on and off magnetic field to said cell.

3. magnetorheological fluid apparatus for work piece holding, comprising:

a. a cell containing a changeable volume hollow space and at least a wall surrounding said space to hold a volume of said magnetorheological fluid;

b. a special fixture inserted and fastened into said cell space and said special fixture having a hollow opening and at least a wall surrounding said hollow opening and a means to fasten a work piece to said special fixture;

c. means to seal said magnetorheological fluid from leaking from said cell;

d. means for applying a magnetic field by at least one permanent magnet to said cell and said magnetorheological fluid;

e. means to adjust a gap in said magnet in which said cell is placed in said magnet gap;

f. means to switch on and off said magnetic field to said cell.

4. An apparatus according to claim 1 wherein an electric magnet produces said magnetic field.

5. An apparatus according to claim 2 wherein an electromagnet produces said magnetic field.

6. An apparatus according to claim 3 wherein an electromagnet produces said magnetic field.

7. An apparatus according to claim 2 wherein a flexible material for sealing is used to change said volume of hollow space in said cell when a pressure is applied to said cell walls.

8. An apparatus according to claim 3 wherein a flexible material for sealing is used to change said volume of hollow space in said cell when a pressure is applied to said cell walls.

9. An apparatus according to claim 4 wherein a flexible material for sealing is used to change said volume of hollow space in said cell when a pressure is applied to said cell walls.

10. An apparatus according to claim 5 wherein a flexible material for sealing is used to change said volume of hollow space in said cell when a pressure is applied to said cell walls.

11. An apparatus according to claim 6 wherein a flexible material for sealing is used to change said volume of hollow space in said cell when a pressure is applied to said cell walls.

* * * * *